US006826869B2

(12) United States Patent
Oberheide

(10) Patent No.: US 6,826,869 B2
(45) Date of Patent: Dec. 7, 2004

(54) POWERED SLIDING PANEL WITH SECONDARY ARTICULATION FOR A MOTOR VEHICLE

(75) Inventor: G. Clarke Oberheide, Troy, MI (US)

(73) Assignee: Intier Automotive Closures Inc., Newmarket (CA)

( * ) Notice: Subject to any disclaimer, the term of this patent is extended or adjusted under 35 U.S.C. 154(b) by 0 days.

(21) Appl. No.: 10/296,071

(22) PCT Filed: May 25, 2001

(86) PCT No.: PCT/CA01/00733

§ 371 (c)(1),
(2), (4) Date: Nov. 21, 2002

(87) PCT Pub. No.: WO01/90523

PCT Pub. Date: Nov. 29, 2001

(65) Prior Publication Data

US 2003/0140563 A1 Jul. 31, 2003

Related U.S. Application Data

(60) Provisional application No. 60/207,052, filed on May 25, 2000.

(51) Int. Cl.[7] ..... E05F 11/00
(52) U.S. Cl. ..... 49/360
(58) Field of Search ..... 49/209, 210, 211, 49/216, 218, 221, 225, 360

(56) References Cited

U.S. PATENT DOCUMENTS

| | | | | | |
|---|---|---|---|---|---|
| 4,462,185 | A | * | 7/1984 | Shibuki et al. | 49/218 |
| 5,896,704 | A | * | 4/1999 | Neag et al. | 49/209 |
| 6,386,621 | B1 | * | 5/2002 | Kozak et al. | 296/155 |
| 6,477,806 | B1 | * | 11/2002 | Asada et al. | 49/169 |

FOREIGN PATENT DOCUMENTS

| | | |
|---|---|---|
| DE | 197 35 181 A1 | 2/1999 |
| EP | 0 644 074 A1 | 9/1994 |
| EP | 0 837 209 A3 | 2/2000 |
| WO | WO 83/03576 | 4/1983 |

* cited by examiner

*Primary Examiner*—Jerry Redman
(74) *Attorney, Agent, or Firm*—Clark Hill PLC

(57) ABSTRACT

An automated closure assembly (20) is disclosed for a motor vehicle (10). A lateral linkage is connected to the drive mechanism (25) receiving the rotational force and translates the rotational force of the drive mechanism into a linear force to move the door between the open position and an intermediate position between the open position and the closed position. The automated closure assembly also includes a secondary linkage that is connected to both the lateral linkage and the drive mechanism. The secondary linkage translates the rotational force into a linear force to move the door between the intermediate position and the open position such that the door is able to move to its open position past the opening within which the lateral linkage extends.

14 Claims, 5 Drawing Sheets

POWERED SLIDING PANEL WITH SECONDARY ARTICULATION FOR A MOTOR VEHICLE

This application is a 371 of PCT/CA61/00733 filed May 25, 2001 which claims benefit of U.S. Application No. 60/207,052 filed May 25, 2000.

BACKGROUND ART

1. Field of the Invention

The invention relates to a system for moving a component part of a motor vehicle. In particular, the invention relates to an actuator used to selectively provide access to an enclosure of a motor vehicle.

2. Description of the Related Art

As motor vehicles characterized by their utility become a mainstream choice, consumers demand certain luxuries primarily associated with passenger cars, either due to their inherent design and/or size. One of the features desired by consumers is the automated movement of such items as sliding doors and lift gates. While features providing automated motion are available, the designs for mechanisms used to accommodate manual overrides are lacking in capability and functionality.

U.S. Pat. No. 5,144,769 discloses an automatic door operating system. This system requires a great deal of control, both by an electronic controller and an operator of the motor vehicle. To overcome forces due to manual operation, the manually operated seesaw switch used by the operator to electromechanically operate the door is in an open state, preventing current from passing through the motor.

SUMMARY OF THE INVENTION

An automated closure assembly is disclosed for a motor vehicle. The motor vehicle includes a body defining an opening and a door that is slideable between a closed position covering the opening and an open position providing access through the opening. The automated closure assembly includes a guide fixedly secured to the motor vehicle at a position in spaced relation to the opening. A drive mechanism is fixedly secured to the guide. The drive mechanism converts electrical energy into a rotational force. A lateral linkage is connected to the drive mechanism receiving the rotational force. The lateral linkage translates the rotational force into a linear force to move the door between the open position and an intermediate position between the open position and the closed position. The automated closure assembly also includes a secondary linkage that is connected to both the lateral linkage and the drive mechanism. The secondary linkage translates the rotational force into a linear force to move the door between the intermediate position and the open position such that the door is able to move to its open position past the opening within which the lateral linkage extends.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 1:
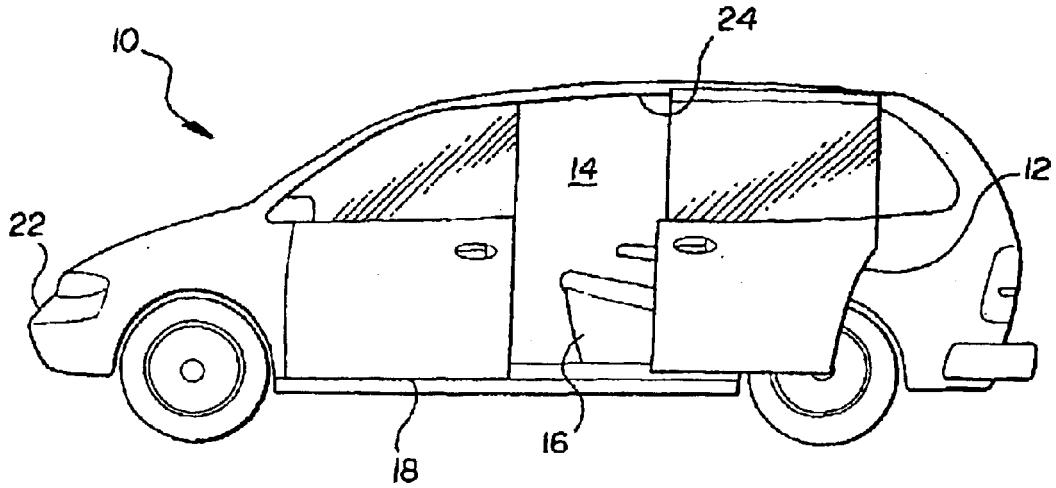
FIG. 1 is a side view of a motor vehicle incorporating one embodiment of the invention, with a sliding door of the motor vehicle in the open position.

Referring to the FIG. 1, a motor vehicle is shown at 10. The motor vehicle 10 includes a sliding door 12 providing access to an inner compartment 14 of the motor vehicle 10. The inner compartment 14 is generally a passenger compartment having a plurality of seat assemblies 16 (one partial seat assembly shown). It should be appreciated that other doors 18 provide access to the inner compartment 14. Further, a plurality of sliding doors 12 may be utilized in one motor vehicle design. Only one is shown in FIG. 1 for simplicity. Throughout this discussion, the orientation from which reference of the invention 20 will be made will be the driver side sliding door 12 with a front being directed toward a front 22 of the motor vehicle 10.

Figure 2:
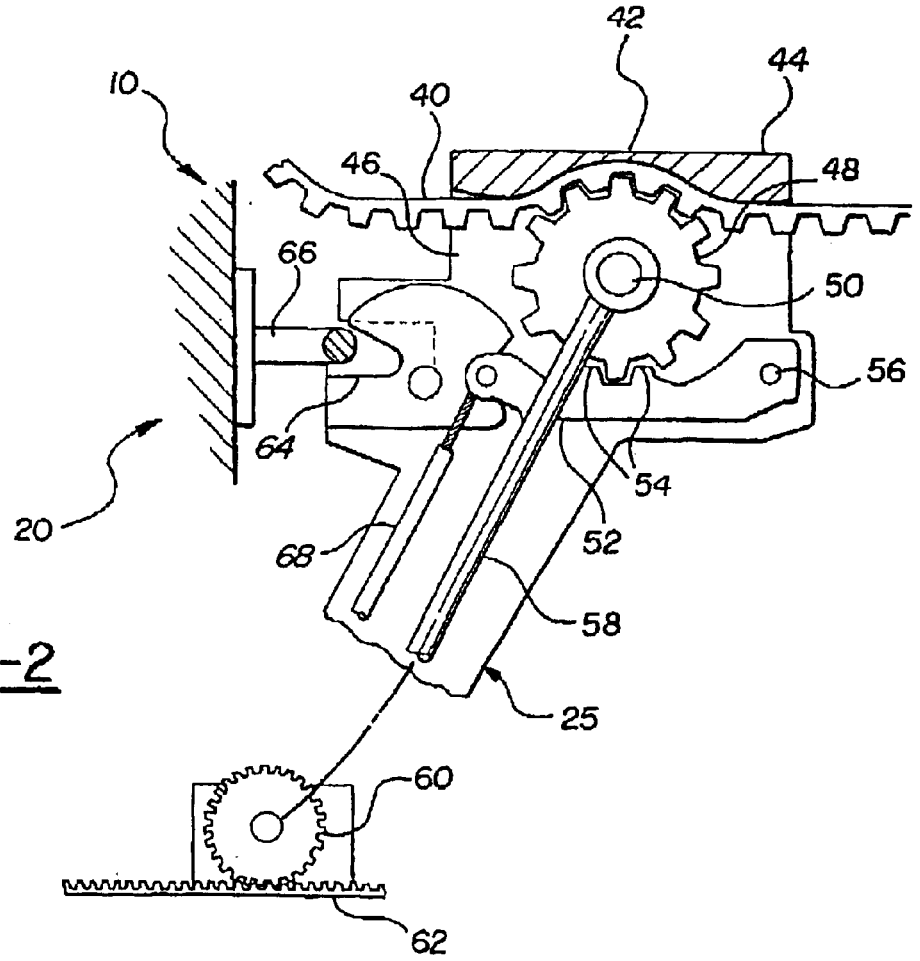
FIG. 2 is a cross-sectional side view, partially cut away, of one embodiment of the invention.

Referring to FIG. 2, the invention 20 is an automated closure assembly. The automated closure assembly 20 provides power to move the sliding door 12 between a closed position and an open position. The closed position is a latched position preventing access to the inner compartment 14. The open position is defined as when the access to the inner compartment 14 is the greatest. In other words, the sliding door 12 is at its furthest most position from the front 22 of the motor vehicle. Referring back to FIG. 1, the sliding door is in an intermediate position defined as a position between the open and closed positions. The intermediate position will be discussed in greater detail subsequently.

The embodiment of the automatic closure assembly 20 shown in FIG. 2 allows for two types of motion for the sliding door 12. The first type of motion is the bidirectional axial motion of the sliding door 12 between its closed position and the intermediate position. The second type of motion is bidirectional axial motion of the sliding door 12 between the intermediate position and its open position. Because an automated closure assembly 20 can only extend as far as the opening of the sliding door 12, it requires a second subassembly, discussed subsequently, to move the sliding door 12 past the opening 24 defined by the motor vehicle 10. The point at which the automated closure assembly 20 cannot move the sliding door 12 past without the aid of the additional subsystem is defined as the intermediate position. The intermediate position is not a median position and is further from the front 22 of the motor vehicle 10 than the median of the opening 24.

Figure 7:
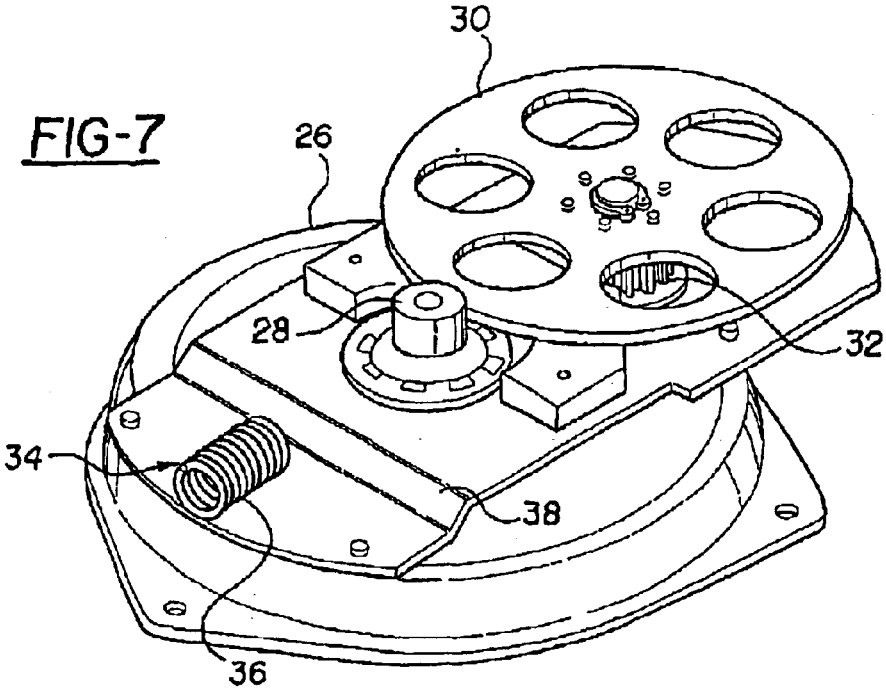
FIG. 7 is a perspective view of a motor incorporated into the second embodiment of the invention.

The automated closure assembly 20 includes a drive mechanism, generally shown at 25. The drive mechanism 25 is driven by a motor 26, shown in FIG. 7. In the preferred embodiment, the motor 26 is a coreless motor 26 for reasons set forth in copending patent application Ser. No. 10/258 644, which is of common assignment, and is hereby incorporated by reference. The coreless motor 26 includes an output gear 28 fixedly secured to an output shaft (not shown) thereof. The output gear 28 drives a transmission gear 30, which, in turn, rotates a motor pulley 32. The motor pulley 32 drives the toothed belt (not shown). The motor 26 provides a support for a belt tensioner 34. The belt tensioner 34 includes a spring 36 and a slideable plate 38 that maintains the belt in the proper tension.

Returning to FIG. 2, the coreless motor 26 drives the drive belt 40. The drive belt 40 is a continuous loop, toothed belt. It travels along a path defined by rollers positioned on a platen (neither shown). A lower hinge, generally shown at 42, is driven by the movement of the drive belt 40. The lower hinge 42 includes a base 44 that includes a channel 46 allowing the drive belt 30 to pass therethrough. A hinge pulley 48 rotates about a shaft 50 that is secured to the base 44 within the channel 46.

During much of the movement of the drive belt 40, the hinge pulley 48 is locked in place against the drive belt 40 by a pulley lock lever 52. The pulley lock lever 52 includes a plurality of teeth 54 that engage the teeth of the drive belt 40.

The pulley lock lever 52 is pivotal about a pin 56. When the pulley lock lever 52 rotates counter clockwise, as taken from the perspective of FIG. 2, the hinge pulley 48 will be unlocked allowing the drive belt 40 to rotate it. The rotation of the hinge pulley 48 rotates a cable 58 that rotates an articulation pulley 60. The articulation pulley 60 moves a rack 62 which is fixedly secured to the sliding door 12, resulting in the articulation of the sliding door 12 away from the intermediate position toward either the open or closed positions.

The hinge lock lever 52 is locked by a fork bolt 64. The rotation of the fork bolt 64 to release the hinge lock lever 52 is initiated by the fork bolt 64 engaging a striker 66. A push pull cable 68, secured to the end of the pulley lock lever 52, locks and unlocks the articulation pulley 60.

Figure 3:
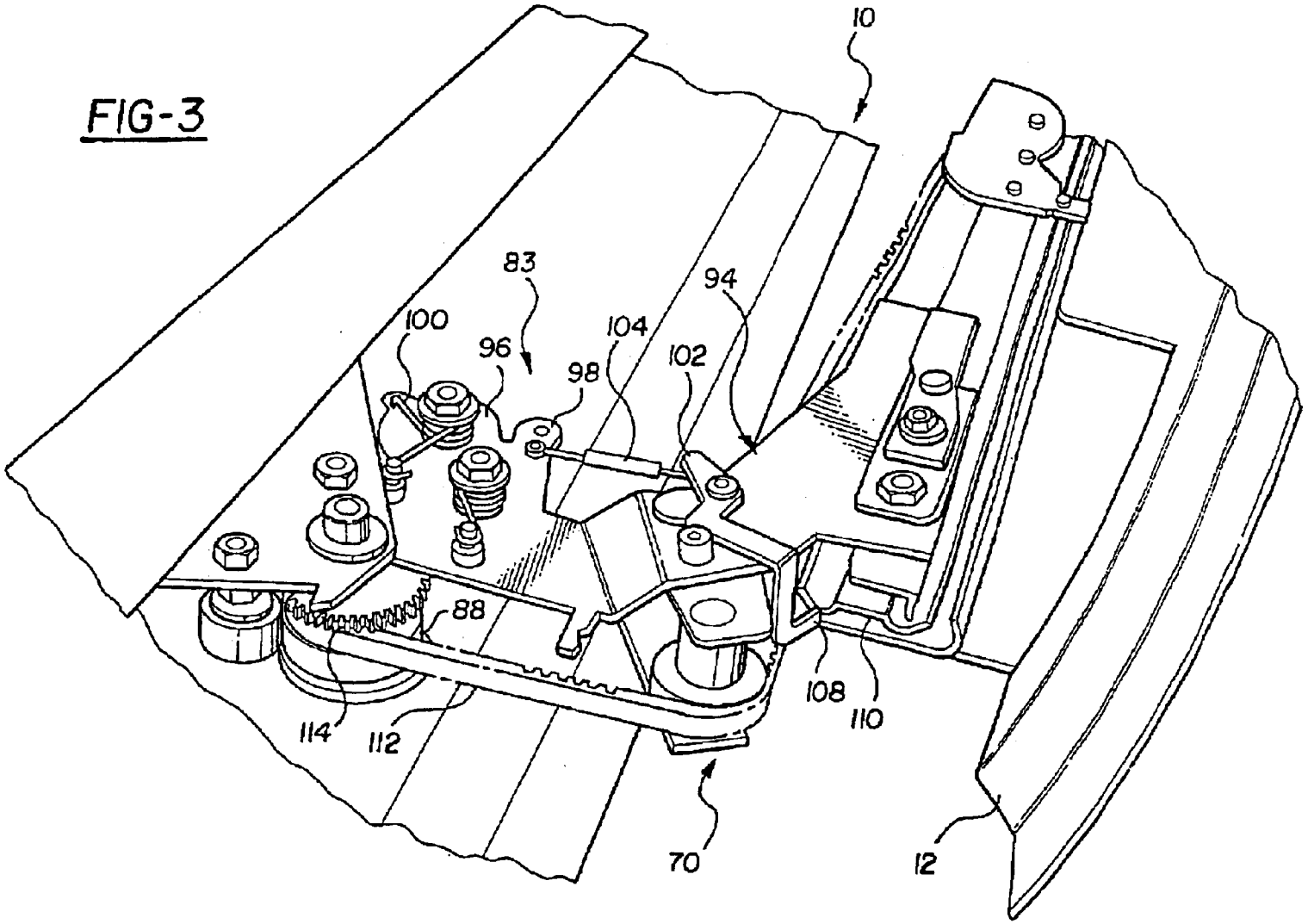
FIG. 3 is a perspective top view, partially cut away, of a portion of a second embodiment of the invention.
Figure 4:
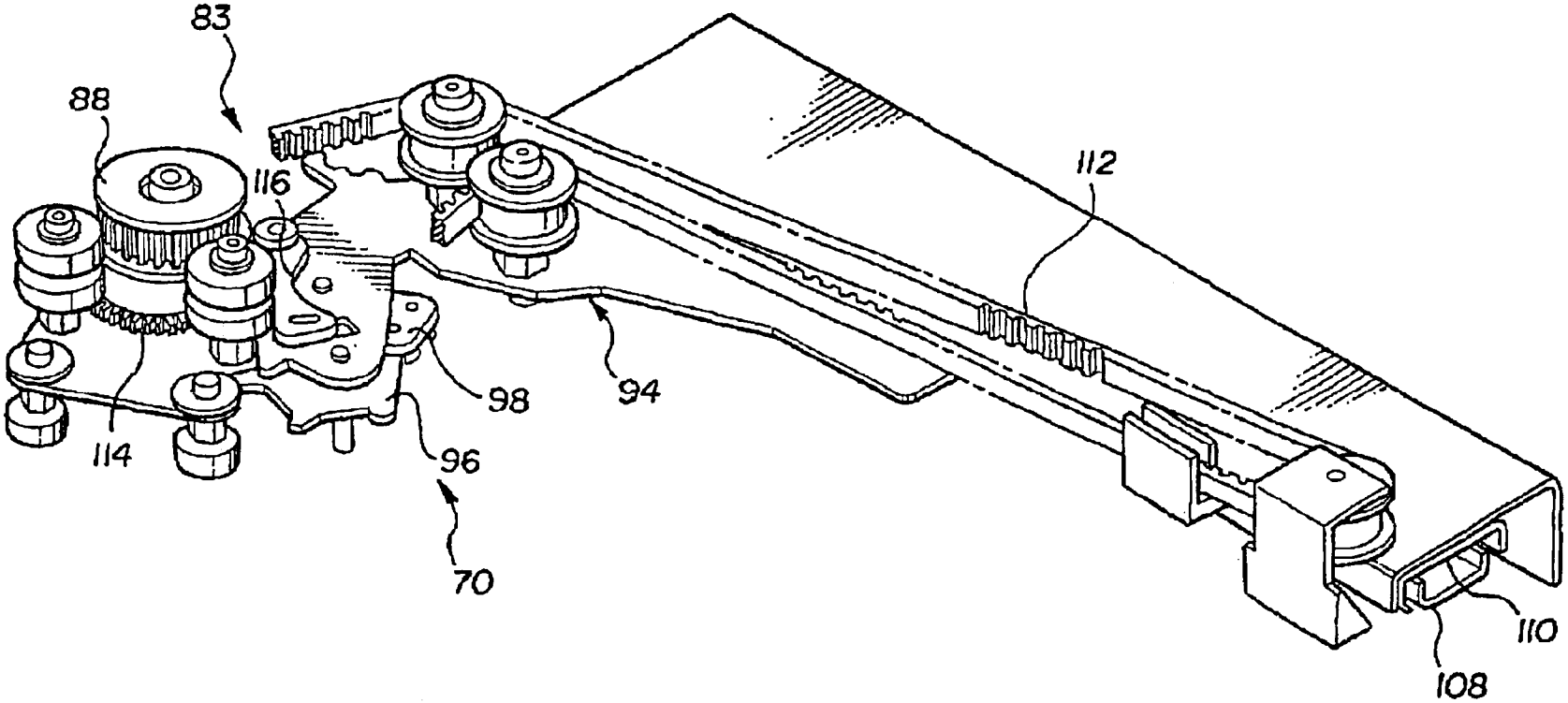
FIG. 4 is a perspective bottom view of the portion of the second embodiment of the invention shown in FIG. 3.
Figure 5:
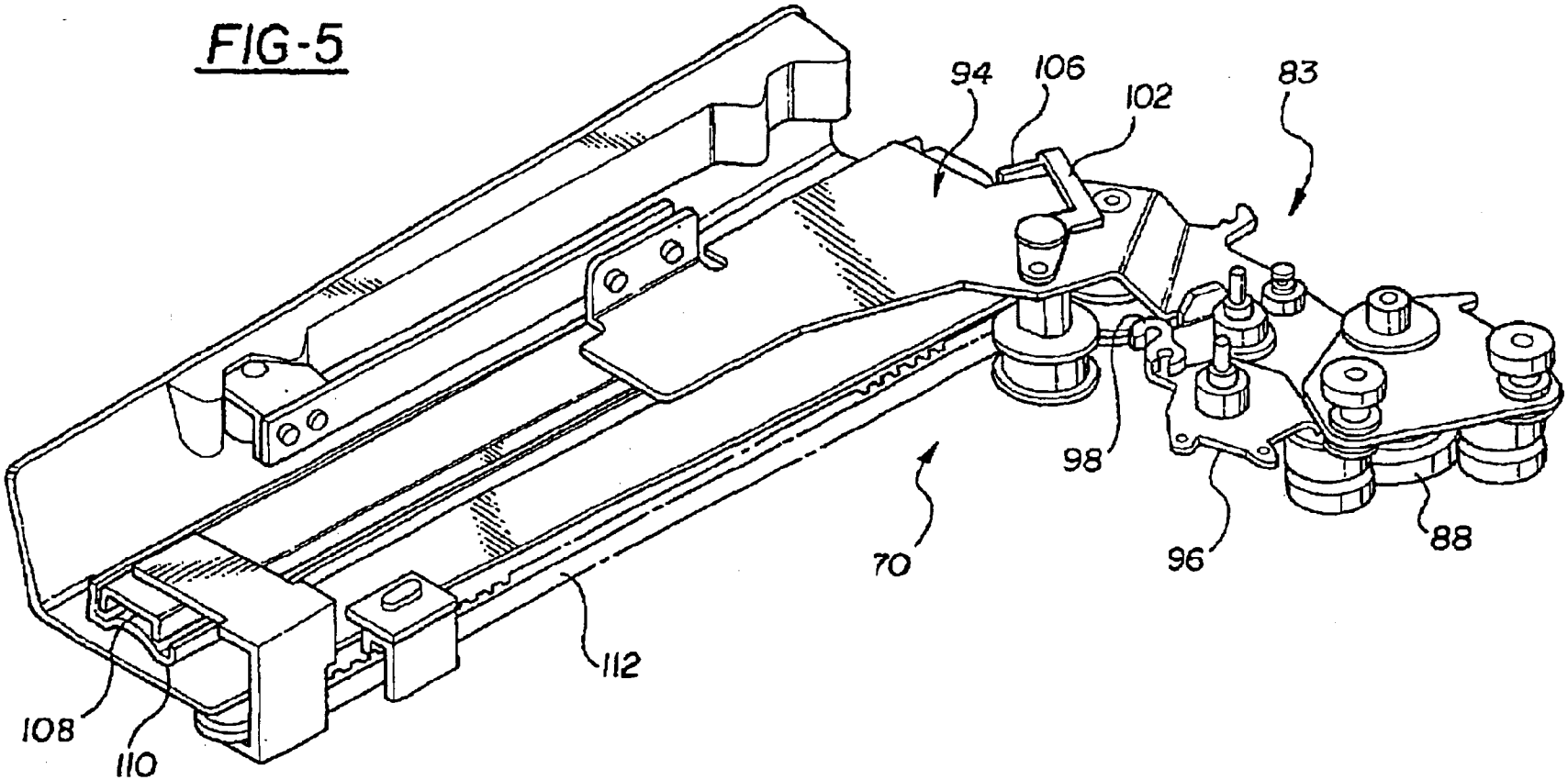
FIG. 5 is a perspective top view of the second embodiment of the invention from another angle.
Figure 6:
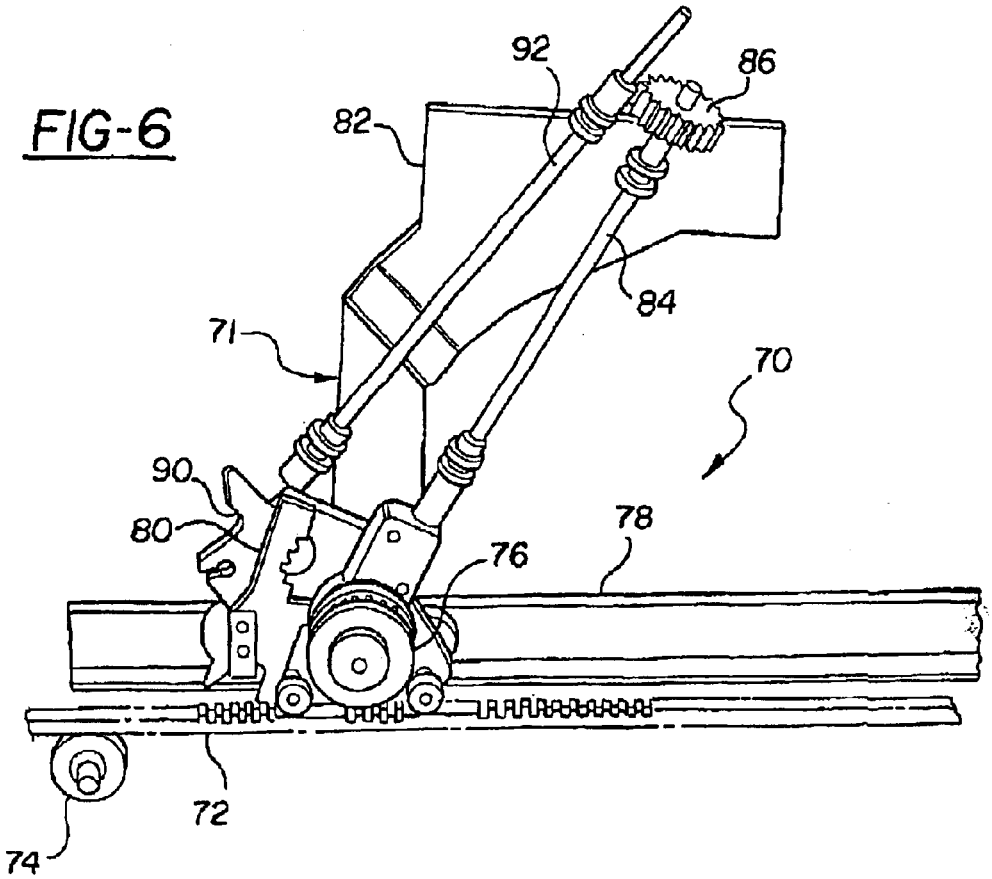
FIG. 6 is a side view, partially cut away, of another portion of the second embodiment of the invention.

Referring to FIGS. 3 through 6, a second embodiment of the automated closure assembly is generally indicated at 70. FIGS. 3 through 5 represent a portion of the invention 70 referred to as the secondary linkage and FIG. 6 represents a portion of the invention referred to as a lateral linkage.

Beginning with the lateral linkage 71 shown in FIG. 6, wherein like named elements represent elements in the first embodiment, FIG. 2, of similar function, a continuous loop, toothed drive belt 72 extends around a path defined by roller 74 (one shown). A hinge pulley 76 travels along a path defined by a bracket 78. The entire lateral linkage 72 travels along the bracket 78 when the drive belt 72 is moving and the hinge pulley 76 is locked in relative position by a pulley lock lever 80. The sliding door 12, represented by extension 82, moves along therewith. As the sliding door 12 moves from the closed position to the intermediate position, the pulley lock lever 80 is moved out of engagement with the hinge pulley 76 allowing the hinge pulley 76 to rotate in response to the travel of the drive belt 72.

A transition linkage, generally shown at 83, extends between the hinge pulley 76 and the sliding door 12. The transition linkage 83 changes the linkage between the coreless motor 26 and the sliding door 12 between the lateral linkage 71 and the secondary linkage 94, discussed subsequently.

The rotation of the hinge pulley 76 rotates a power cable 84. The power cable 84 rotates a power gear 86. The power gear 86 rotates an transition pulley 88, discussed subsequently.

The pulley lock lever 80 is rotated when a lock ratchet 90 is pivoted. The lock ratchet 90 is controlled by a push pull cable 92. The movement of the push pull cable 92 will also be discussed in greater detail subsequently.

Returning to the secondary linkage, generally shown at 94, the push pull cable 92 (not shown in FIGS. 3 through 5) is secured to a secondary ratchet 96. The secondary ratchet 96 is held in a specific orientation by a pawl 98. The secondary ratchet 96 is spring loaded by spring 100 to maintain the push pull cable 92 in an extended position allowing the pulley lock lever 80 to remain in a locked position keeping the hinge pulley 76 from rotating.

The pawl 98 is linked to a bell crank 102 via a rod 104. In the embodiment shown in FIGS. 3 through 5, the rod 104 is shown as a two-piece adjustable rod 104. It should be appreciated by those skilled in the art that a simple rod 104 may be used.

The bell crank 102 includes a receiving extension 106. The receiving extension 106 selectively receives a slide 108 that moves axially with the sliding door 12 through a guide 110. Therefore, movement of the sliding door 12 from its open position to the intermediate position pivots the bell crank 102 to pull the pawl 98 away from the secondary ratchet 96 allowing it to return to its disengaged position which, in turn, allows the pulley lock lever 80 to lock the hinge pulley 76 to move lateral linkage 71. Lateral movement of the lateral linkage 71 allows the sliding door 12 to move past the intermediate position toward the closed position.

The slide 108 is moved, i.e., movement of the sliding door 12 between the intermediate and open positions, by a secondary belt 112. The transition pulley 88 drives the secondary belt 112. The transition pulley 88 is coaxially mounted to the secondary linkage 94 with a secondary gear 114. The secondary gear 114 receives its rotational power from the power gear 86 of the lateral linkage 71.

Referring specifically to FIG. 4, a dog 116 is connected to a back side of the secondary ratchet 96. The dog 116 holds the secondary gear 114 in a position to receive power from the power gear 86. When the pawl 98 releases the secondary ratchet 96, the dog 116 moves the secondary gear 114 out of engagement with the power gear 86 preventing any forces from being applied to the sliding door 12 via the slide 108. This allows for the sliding door 12 to latch in the closed position with a minimal effort.

In the operation of unlatching the sliding door 12 from its closed position and moving it to its open position, the coreless motor 26 is activated and rotates the drive belt 72. Because the hinge pulley 76 is locked by the pulley lock lever 80, the hinge pulley 76 travels with the drive belt 72. This moves the sliding door 12 from the closed position toward the intermediate position.

The lock ratchet 90 engages a striker (not shown) that pivots the pulley lock lever 80 out of engagement with the hinge pulley 76. This allows the hinge pulley 76 to rotate with the passing of the drive belt 72 thereby. Movement of the lock ratchet 90 also moves the secondary ratchet 96 through the push pull cable 92.

This forces the secondary gear 114 into engagement with the rotating power gear 86. The rotation of the secondary gear 114 moves the secondary belt 112 to move the slide 108 and the sliding door 12 out from the intermediate position to the open position.

The return of the sliding door 12 reverses this operation with the addition of using the bell crank 102 to move the secondary ratchet 96, through pawl 98, back to its inactive position allowing the pulley lock lever 80 back into engagement with the hinge pulley 76 to lock the hinge pulley 76 in a specific orientation. The return of the lateral linkage 71 to its original position returns the sliding door 12 to its closed position.

The invention has been described in an illustrative manner. It is to be understood that the terminology which has been used is intended to be in the nature of words of description rather than of limitation.

Many modifications and variations of the invention are possible in light of the above teachings. Therefore, within the scope of the appended claims, the invention may be practiced other than as specifically described.

We claim:

1. An automated closure assembly for a motor vehicle defining an opening, the motor vehicle including a door slideable between a closed position covering the opening and an open position providing access through the opening, said automated closure assembly comprising:

a guide fixedly secured to the motor vehicle at a position in spaced relation to the opening;

a drive mechanism including a motor fixedly secured to said guide, said drive mechanism converting electrical energy into a rotational force, said drive mechanism including a hinge pulley for receiving the rotational force of said motor at a location remote from said motor, said hinge pulley including a plurality of pulley teeth, a drive belt extending along the opening of the motor vehicle, said drive belt including a plurality of belt teeth to engage said plurality of pulley teeth to move said hinge pulley therealong, and a pulley lock lever selectively engagable with said hinge pulley preventing said hinge pulley from rotating when the door is between the closed position and said intermediate position;

a lateral linkage connected to said drive mechanism receiving said rotational force and translating said rotational force into linear force to move the door between the open position and an intermediate position between the open position and the closed position; and a secondary linkage connected to said lateral linkage and said drive mechanism for translating said rotational force into a linear force to move the door between said intermediate position and the open position such that the door is able to move to its open position past the opening within which said lateral linkage extends and a transition linkage connected between said lateral linkage and said secondary linkage, said transition linkage selecting between said lateral linkage and said secondary linkage to translate said rotational force of said drive mechanism.

2. An automated closure assembly as set forth in claim 1 wherein said transition linkage includes a connector for connecting said transition linkage to said pulley lock lever.

3. An automated closure assembly as set forth in claim 2 wherein said secondary linkage includes a guide fixedly secured to and extending perpendicularly out from the door.

4. An automated closure assembly as set forth in claim 3 wherein said secondary linkage includes a slide axially movable with respect to said guide.

5. An automated closure assembly as set forth in claim 4 wherein said transition linkage includes a bell crank engagable with said slide when said door moves toward said intermediate position from the open position.

6. An automated closure assembly as set forth in claim 5 wherein said transition linkage includes a pawl and ratchet, said pawl linked to said bell crank such that said pawl disengages said ratchet when said slide engages said bell crank.

7. An automated closure assembly as set forth in claim 6 wherein said transition linkage includes a dog moveable between an engaged position and a disengaged position.

8. An automated closure assembly as set forth in claim 7 wherein said transition linkage includes a transition pulley movable by said dog between an engagement position and a disengagement position, said transition pulley movable between said engagement and disengagement positions when said dog is movable between said engaged and disengaged positions.

9. An automated closure assembly as set forth in claim 8 wherein said pawl is connected to sail lateral linkage to selectively drive said secondary linkage.

10. An automated closure assembly for a motor vehicle defining an opening, the motor vehicle including a door slideable between a closed position covering the opening and an open position providing access through the opening, said automated closure assembly comprising:

a guide fixedly secured to the motor vehicle at a position in spaced relation to the opening;

a drive mechanism, including a motor and a drive belt, fixedly secured to said guide, said drive mechanism converting electrical energy into a rotational force;

a lateral linkage connected to said drive mechanism receiving said rotational force and translating said rotational force into a linear force to move the door between the open position and an intermediate position between the open position and the closed position, said lateral linkage including a hinge pulley rotatable with respect to the motor vehicle and movable axially with respect to the motor vehicle wherein said hinge pulley receives the rotational force of said motor at a location remote from said motor, said hinge pulley including a plurality of pulley teeth;

a secondary linkage, including a slide and a guide fixedly secured to and extending out of the door, connected to said lateral linkage and said drive mechanism for translating said rotational force into a linear force to move the door between said intermediate position and the open position such that the door is able to move to its open position past the opening within which said lateral linkage extends; and a transition linkage, including a bell crank engagable with said slide when said door moves toward said intermediate position from the open position, connected between said lateral linkage and said secondary linkage, said transition linkable selecting between said lateral linkage and said secondary linkage to translate said rotational force of said drive mechanism.

11. An automated closure assembly as set forth in claim 10 wherein said transition linkage includes a pawl and ratchet, said pawl linked to said bell crank such that said pawl disengages said ratchet when said slide engages said bell crank.

12. An automated closure assembly as set forth in claim 11 wherein said transition linkage includes a dog moveable between an engaged position and a disengaged position.

13. An automated closure assembly as set forth in claim 12 wherein said transition linkage includes a transition pulley movable by said dog between and engagement position and a disengagement position, said transition pulley movable between said engagement and disengagement positions when said dog is movable between said engaged and disengaged positions.

14. An automated closure assembly as set forth in claim 13 wherein said pawl is connected to said lateral linkage to selectively drive said secondary linkage.

* * * * *